United States Patent [19]

Stevenson et al.

[11] Patent Number: 4,925,186

[45] Date of Patent: May 15, 1990

[54] PORTABLE PITCHER'S MOUND

[75] Inventors: James W. Stevenson, Toronto, Ontario; Paul T. Arato, Willowdale, Ontario, both of Canada

[73] Assignee: James William Stevenson, Toronto, Ontario, Canada

[21] Appl. No.: 247,557

[22] Filed: Sep. 22, 1988

[51] Int. Cl.[5] ..... A63B 71/00

[52] U.S. Cl. ..... 273/25

[58] Field of Search ..... 273/25, 26; D21/199; 206/557; 301/105 B; 73/441

[56] References Cited

U.S. PATENT DOCUMENTS

| | | | |
|---|---|---|---|
| 2,156,469 | 5/1939 | Boltz | 273/2 S |
| 3,008,719 | 11/1961 | Misko | 273/58 RX |
| 3,236,520 | 2/1966 | Friedman | 273/26 R |
| 3,479,028 | 11/1969 | Goeders | 273/25 |
| 3,703,285 | 11/1972 | Perry et al. | 273/2 S |
| 4,063,729 | 12/1977 | Hollaway | 273/25 |
| 4,306,718 | 12/1981 | Goeders | 273/25 |
| 4,529,253 | 7/1985 | Ho | 301/105 BX |
| 4,561,653 | 12/1985 | Wright | 273/25 |
| 4,666,155 | 5/1987 | Stille | 273/25 |
| 4,749,223 | 6/1988 | Goeders | 273/25 |

*Primary Examiner*—Edward M. Coven
*Assistant Examiner*—Sebastiano Passhniti
*Attorney, Agent, or Firm*—Rogers, Bereskin & Parr

[57] ABSTRACT

A pitcher's mound on, which a pitcher in the sport of Baseball stands while pitching the ball, is collapsible, and is made up of several wedge-shaped segments which are connected to a central hub in an easily releasable manner. The segments and the central hub are quite rigid yet are of a size and weight which makes them reasonably portable. The surface of the pitcher's mound can be such as to absorb impact when struck by a ball and to provide good footing for the pitcher.

25 Claims, 4 Drawing Sheets

PORTABLE PITCHER'S MOUND

FIELD OF THE INVENTION

This invention relates to ground equipment used in the sport of baseball, and more particularly to a pitching mound which is portable and of knock-down construction.

BACKGROUND OF THE INVENTION

In the sport of baseball the position of pitcher requires the throwing or "pitching" of a ball so that it passes over a plate beside which a participant in the position of batter stands and attempts to strike the ball with a baseball bat. Rules governing the sport of baseball require that the pitcher throw the ball from an upraised portion of the playing field called a pitcher's mound. The rules further require that for a pitch to be valid, the pitcher must have one foot in contact with a slab installed at the pitcher's position at the moment of delivery. This slab is commonly referred to in the sport as a "rubber". The size and relative disposition of such elements as the plate, rubber and pitcher's mound are specified in the rules. It is customary but not necessary to provide a recess or "divot" adjacent the edge of the rubber facing the plate for the pitcher's toes at the moment of delivery.

Aside from the exact shape of the mound required by the rules, the shape of the pitching mound has considerable effect on the pitcher's action. As he pitches, his leading foot will land at a position significantly lower than the trailing foot. Also, due to the height of the mound, the pitcher is effectively pitching down to the batter. For this reason, pitchers develop actions dependant on the shape of the mound. During winter, it is common for baseball players to practice indoors in a gymnasium or the like. However, to the Applicant's knowledge, at the present time there is no readily available device for simulating a pitcher's mound. Consequently, indoor pitching practice is often carried out on a level floor. This is awkward for the pitcher, and can detrimentally effect his pitching style.

Portable pitcher's mounds have been developed which enable the sport of baseball to be played on flat fields, which can also be used to convert a regular sized baseball field to reduced size for junior and little league games by placing the pitcher's mound the proper distance from home plate for a youthful player and which furthermore allow the pitcher to practice indoors during inclement weather. Examples of such portable pitcher's mounds can be found in the following U.S. Patents:

U.S. Pat. No. 2,156,469 (Boltz)
U.S. Pat. No. 3,703,285 (Perry)
U.S. Pat. No. 4,063,729 (Hollaway)
U.S. Pat. No. 4,306,718 (Goeders)

Some of the earlier designs for portable pitcher's mounds have the disadvantage of inadequate rigidity which allows them to flex beneath the pitcher's feet and thus interfere with the accuracy of the throw. Also, many of the earlier designs are difficult to transport as they are too large to fit into the luggage compartment of an automobile. Those prior designs which do fit into the luggage compartment of an automobile are limited in size by the dimensions of the average automobile luggage compartment. As pitcher's mounds can be on the order of ten feet in diameter, aside from the portability considerations, storage can be a problem. Since portable mounds are often used indoors in gymnasiums or sports halls, they must be capable of being moved and stored to allow other activities and sports.

A further disadvantage of some of the earlier designs for portable pitcher's mounds is that their surface is much harder than that of permanent mounds which ordinarily are made of earth or clay. It is desirable that a portable or artificial mound simulate the behaviour of a clay mound, with respect to both how the ball bounces off it and how it feels to the pitcher. These prior pitcher's mounds therefore create a hazard in that when struck by a baseball, they do not absorb as much of the impact as would a clay or earth mound so that the baseball may be deflected up to potentially injure the pitcher. The possibility of such injury is greater in junior and little league games where the pitcher has less experience and is less likely to take appropriate action.

U.S. Pat. No. 4,063,729 attempts to overcome this hazard by shaping the edge of the pitcher's mound facing the batter so as to deflect the ball away from the pitcher. A disadvantage of providing such a deflecting edge is that the bounce of the baseball striking this edge would be erratic and therefore not representative of the result that would be obtained from striking a clay or earth mound.

It is desirable to have a pitching mound complete with rubber and divot, of knock-down construction, which is portable and easily assembled to provide a rigid structure which will not flex beneath the pitcher's feet in such a manner as to impair his throw. It is further desirable that the surface of the mound provide a good grip for the pitcher's feet and also absorb some of the impact when struck by a baseball so as not to deflect the ball up at the pitcher to potentially injure the pitcher.

BRIEF SUMMARY OF THE INVENTION

In accordance with the present invention there is provided a portable pitcher's mound comprising a central hub and a plurality of individual components surrounding the central hub, which can be disassembled and separated, and connecting means for releasably connecting the individual components and the central hub together to form a pitcher's mound wherein each of the components has a top layer and a bottom layer, whereby surface of the pitcher's mound, and at least part of the bottom layer of each component lies in a common horizontal support plane. The hub can be provided with either a full complement of components surrounding the hub, or just one or two components. The provision of just one or two will make for a cheaper and simpler assembly.

In a variant, the central hub is omitted and the mound is formed solely by arcuate segments.

BRIEF DESCRIPTION OF THE DRAWINGS

For a better understanding of the present invention, and to show more clearly how it may be carried into effect, reference will now be made, by way of example, to the accompanying drawings, which show preferred embodiments of the present invention in which.

DESCRIPTION OF THE PREFERRED EQUIPMENT

Figure 1:
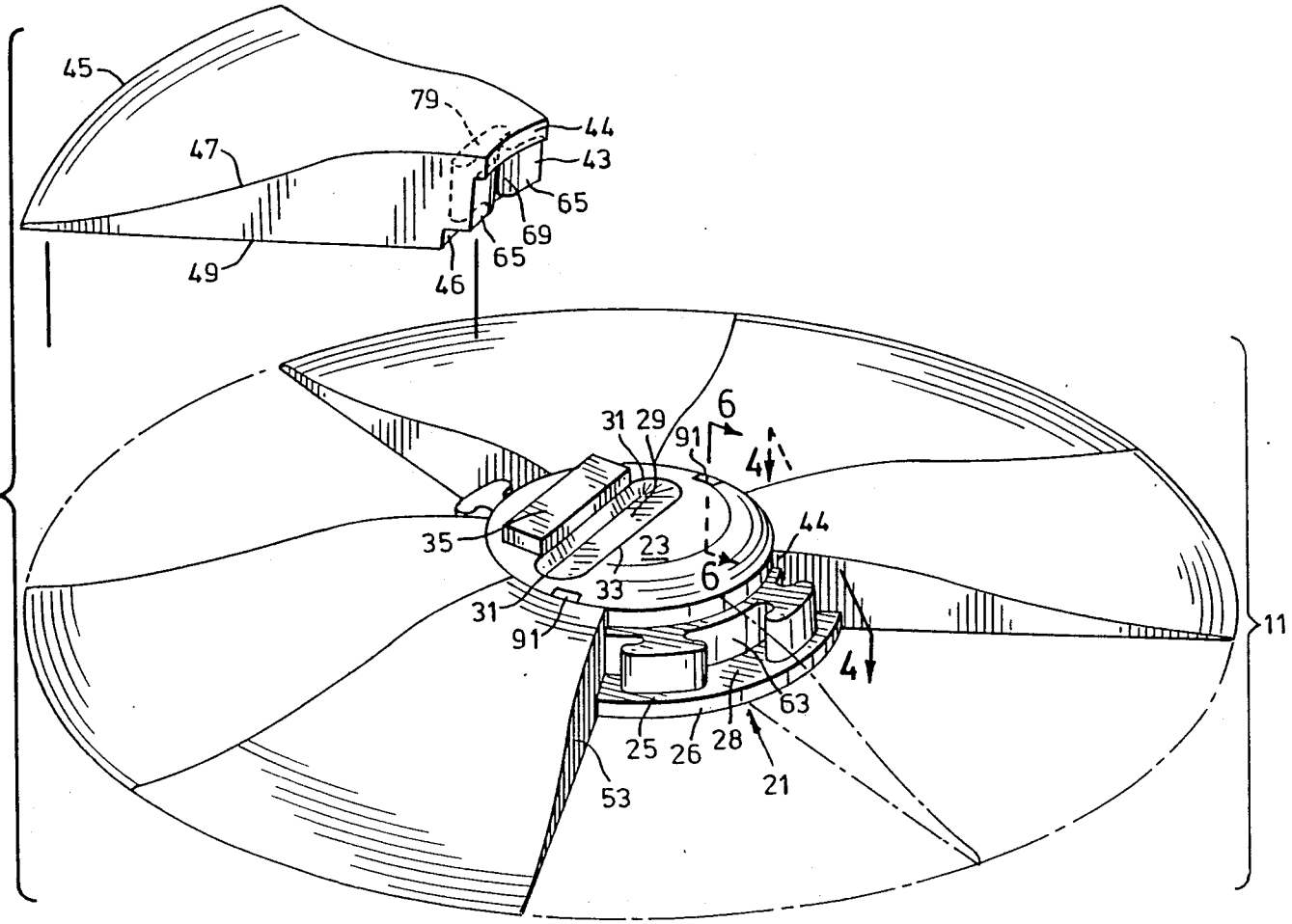
FIG. 1 is a perspective view of an embodiment of the invention in partially assembled condition.

The portable pitcher's mound shown as 11 in FIG. 1 comprises a central hub 21 releasably connected to a plurality of arcuate segments 41 by connecting means. The arcuate segments 41 are preferably of similar shape and construction and thus interchangeable to ease assembly and even wear.

Figure 2:
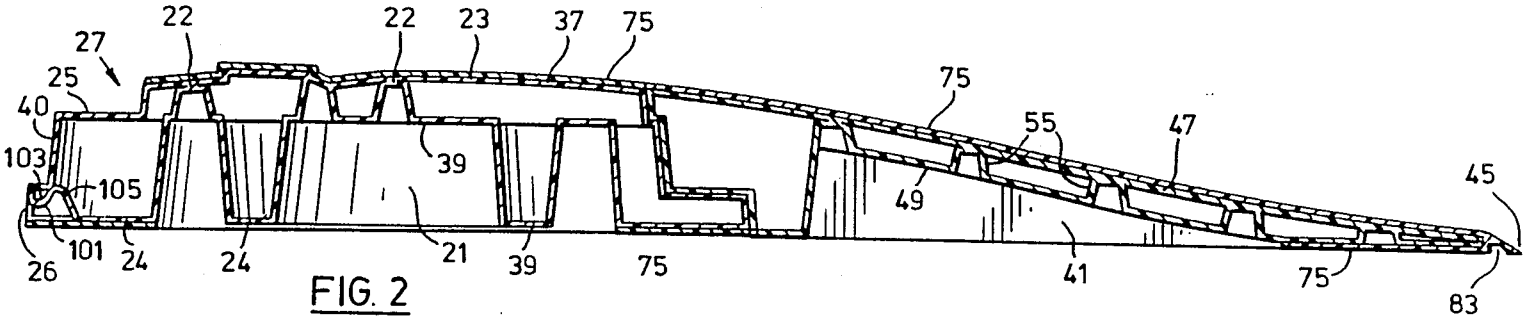
FIG. 2 is a sectional view along Line 2—2 in FIG. 5.

The central hub 21 is of slightly domed topped cylindrical shape with the inner portion 23 rising above the outer annular portion 25 to give a step-like configuration to a cross section taken through the axis of the central hub radially outward, as can be seen at 27 in FIG. 2. The bottom portion of the outer face 40 of the outer annular portion 25 projects radially outward to form a lower lip 26 which encircles the outer annular portion 25.

The top of the inner portion 23 is even except for a rounded rectangular recessed portion forming the divot 29 in FIG. 1 which accommodates the pitcher's toes during delivery of the ball. If desired, the top of the inner portion 23 can be made without a divot 29. The ends of the divot 29 shown as 31 in FIG. 1 are approximately equidistant from the edge of the inner portion 23 of the central hub 21. The inner edge 33 of the divot lies approximately along a line defining the diameter of the central hub. The divot is therefore offset from the centre of the central hub as can be seen in FIG. 1. While this offset is not essential, it allows a smaller diameter to be used for the pitcher's mound 11.

Adjacent the edge of the divot 29 opposite the edge 33 is secured a raised rectangular block which is the pitcher's rubber 35 in FIG. 1. The rubber 35 is preferably made of rubber but may be made of other materials such as wood or plastic. The rubber is secured to the top of the central hub 23 by suitable fastening means such as adhesives or screw-type fasteners. Alternatively, if the central hub is of a moulded construction, the rubber 35 can be formed integrally with the top of the inner portion 23 of the central hub.

Figure 5:
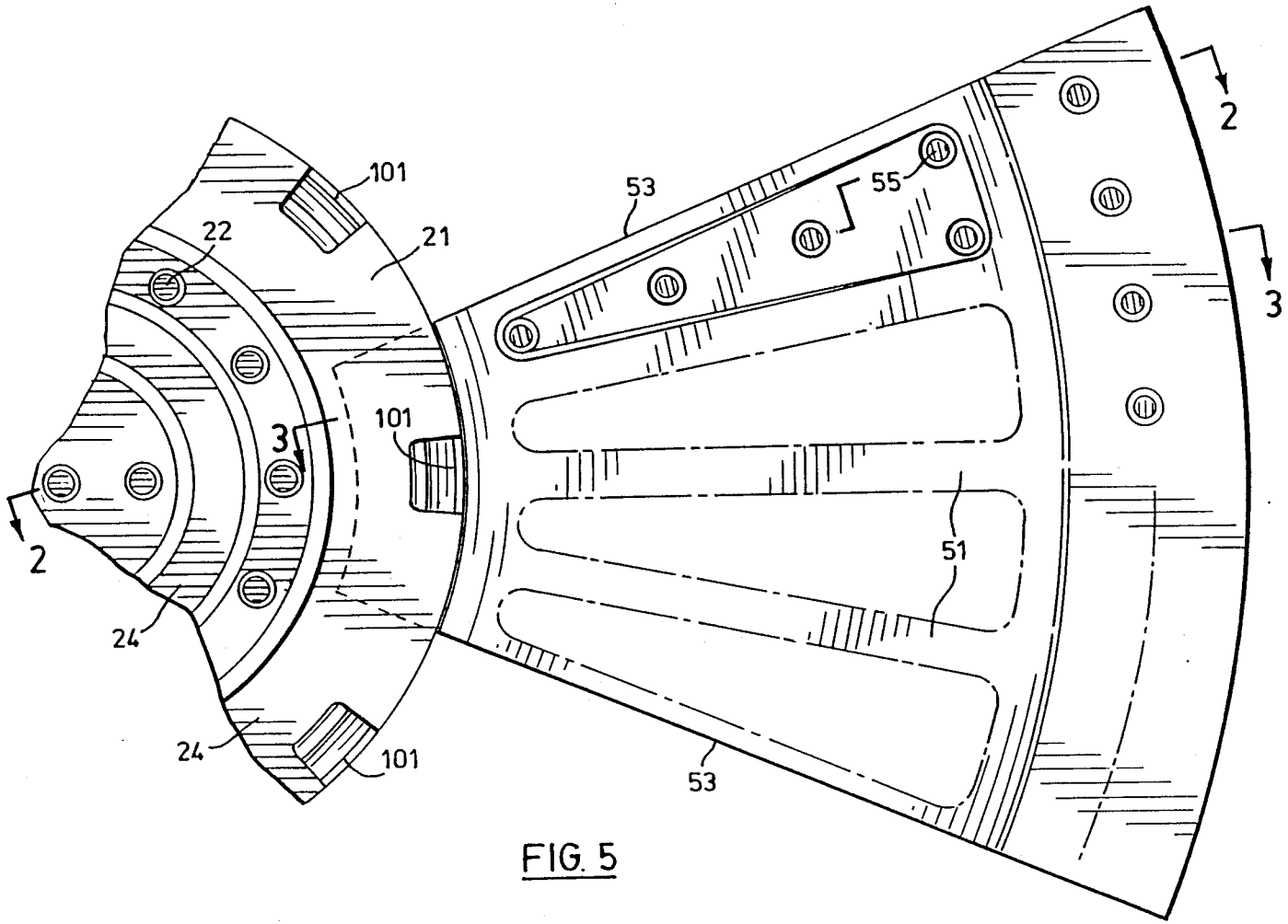
FIG. 5 is a plan view of the bottom of an arcuate segment and part of the hub in the direction of arrow 5 of FIG. 1.

The central hub construction is rigid enough not to flex appreciably under the pitcher's feet during delivery, thereby interfering with the pitch, yet light enough to be carried by one person. This is achieved by making the central hub with a hollow two-layer construction, the top layer 37 conforming to the desired shape of the central hub and the bottom layer 39 being shaped so as to support and stiffen the outer layer. FIG. 2 shows the two-layer construction for the central hub which is moulded from a thermoplastic material. The top layer 37 as shown in FIG. 2 comprises the top of the inner portion of the central hub 21. The bottom layer 39 of the central hub comprises inner and outer annular rings 24 of generally U-shaped cross-sections and joins with the top layer around the outer edge 40 of the outer annular portion 25 and at certain cup-shaped projections or portions 22 in the bottom layer. The cup-shaped projections 22 are shown in FIG. 5 as being equidistantly spaced around the circumference of that annular portion of the bottom layer 39 which is between the open ends of the U-shaped annular rings 24. The projections 22 are also provided in a central part of the bottom layer 39 within the inner and outer rings 24. The bottom or closed ends of the U-shaped annular rings 24 rest on the ground and the sides of these rings serve to support the top layer 37 of the central hub 21. Loading forces on the top layer 37 are transmitted to the bottom layer 39 by way of the cup-like projections or portions 22. The top layer is preferably joined to the bottom layer at the top of the projections 22 by means such as fusion or adhesives to improve the lateral stiffness of the central hub by eliminating relative movement between the top and bottom layers.

The arcuate segments 41 in FIG. 1 have an inner curved surface 43 and an outer edge 45. Above the inner surface, there is an upper lip 44 that extends radially inwards. Below the inner surface is a lower recess 46 which extends radially outwards. The inner surface 43, lip 44 and lower recess 46 are shaped so as to conform to the outer dimensions of the central hub. Therefore, the upper lip 44 at the top 47 of the arcuate segment 41 is of the same radius of curvature as the inner portion 23 of the central hub 21 and the lower recess 46 is of the same depth and radius of curvature as the lower lip 26 of the central hub 21. The lower portions of the inner surface 43 have T-shaped slots for T-shaped portions of the outer annular portion 25 of the central hub 21 as detailed below. This enables the arcuate segments 41 to be placed against the central hub 21 with the top of the upper lip 44 lying against the outer edge of the inner portion 23 of the central hub 21.

The upper lips 44 of the arcuate segments 41 are of the same height as the top of the inner portion 23 of the central hub 21. The height of the top 47 of the arcuate segments decreases radially outward toward the outer edges 45 of the arcuate segments so that at the outer edges 45 the top 47 is approximately flush with the surface on which the arcuate segments rest. The curvature of the surface of the top 47 of the arcuate segments may be constant or may alternately be varied so that the slope of the surface of the top 47 is less steep at the upper lip 44 and at the outer edge 45 than it is between these parts.

Figure 3:
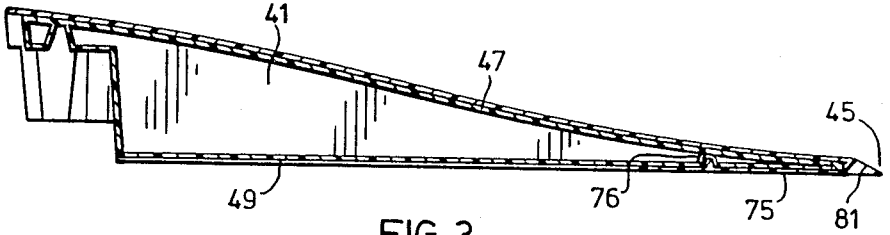
FIG. 3 is a sectional view along Line 3—3 in FIG. 5.

It is desirable to have the arcuate segment construction rigid enough to minimize flexibility when supporting the pitcher's weight, while being light enough to be carried by one person. Such a construction is shown in FIGS. 2 and 3 which show a hollow two-layer construction for the arcuate segments. In this embodiment, the top layer is the top 47 of the arcuate segment. The bottom layer 49 comprises a series of struts 51 in FIG. 5 of generally U-shaped cross-sections, the bottom or closed portion of the struts 51 resting on the ground in a common horizontal support plane with the bottom ends of the annular rings 24 of the central hub. In the area between the top or open portions of the struts 51, the bottom layer 49 of the arcuate segments approximately parallels the top 47 of the arcuate segments, being separated therefrom by cup-shaped projections 55 in FIGS. 2 and 5 similar to the cup-shaped projections 22. Preferably the projections 55 are affixed to the top layer at the points of contact to reduce flexibility in the arcuate segments by preventing relative movement between the top and bottom layers 47, 49. Such attachment can be achieved by various means examples of which are fusion and gluing.

One manner of constructing the hub and the arcuate segments is to mould them from plastic.

The arcuate segments connect with the central hub via connecting means to form the convex pitcher's mound 11 having a flat central portion tapering down to the ground around the outer edges 45 of the arcuate segments 41. The arcuate segments meet each other along their sides 53 and the inner surfaces 43 and lips 44 of the arcuate segments 41 meet the inner portion 23 of the central hub to give a smooth, relatively continuous surface.

Figure 4:
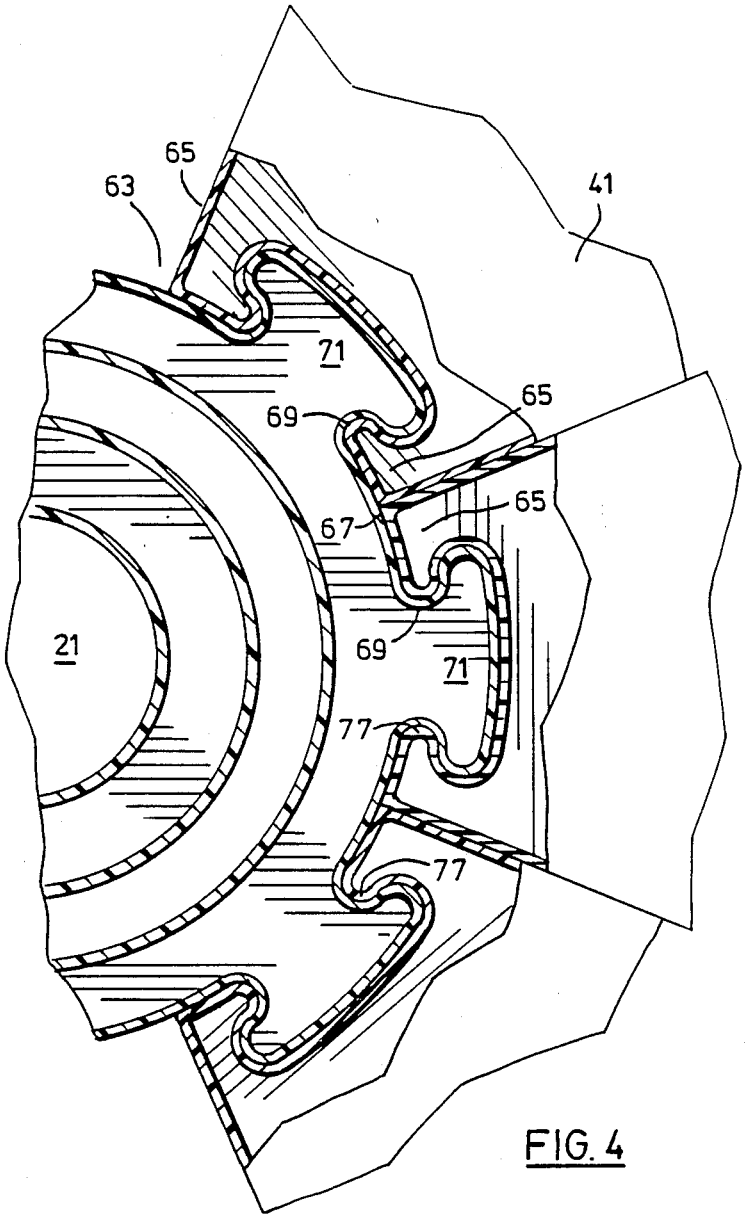
FIG. 4 is a sectional view along Line 4—4 in FIG. 1.

The connecting means are shown in FIGS. 1 and 4 and compromise vertically sided slots 63 in the outer annular portion 25 of the central hub 21. Each slot 63 opens both onto the cylindrical outer surface of the annular portion 25 and upwardly onto the step 27. Each slot 63 has a curved inner face 67 centered on the axis of the hub 21 and curved ends 69, and is generally T-shape in horizontal section (FIG. 4). The bottoms of the slots are flush with the top surface 28 of the lower lip 26 which runs around the outer annular portion 25. As also shown in FIG. 4, this leaves T-shape portions 71 between adjacent slots 63.

Correspondingly shaped projections 65 are provided on either side of the inner surface 43 of each arcuate segment 41. The inner curved face 43 has the same radius as the curved inner faces 67. One side of each projection 65 is a continuation of the segment side 53. Each projection includes a concave face as part of the curved surface 43. The projections 65 have round portions 77, of approximately hemispherical section, facing one another and corresponding to the curved ends 69 of the slots 63. The projections 65 then define a T-shaped slot 79 between them, corresponding in shape to the T-shaped projections or portions 71.

In use, as shown, the mound 11 is assembled by sliding the projections 65 into the slots 63, which can also be considered as the T-shaped portions 71 sliding into the T-shaped slots 79. As shown in FIG. 4 adjacent pieces of projections 65 of two adjacent segments 41 fit together in one slot 63.

This thus enables the central hub 21 and the eight segments 41 to be readily assembled and disassembled. The mound 11 can have the following approximate dimensions, height 10" and diameter 13'. This then enables it to be separated in components with a maximum dimension of less than five feet, for ease of storage. No separate fasteners are required to maintain the mound assembled. As the segments 41 are interchangeable, they can be moved relative to the hub 21, e.g. each time the mound is assembled, so that any wear occurs evenly on the segments 41.

Figure 6:
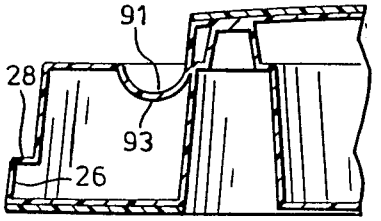
FIG. 6 is a sectional view along line 6—6 in FIG. 1.

Separation of the arcuate segments 41 from the central hub can be facilitated by providing a recess 91 in FIG. 1 in the inner portion 23 of the central hub 21 to allow insertion of one's fingers beneath the upper lip 44 of one arcuate segment 41 to grip the upper lip 44. The recess 91 in FIG. 1 is generally rectangular with a rounded bottom 93 (FIG. 6) depending below the top of the outer annular portion 25. The recess 91 therefore has a J-shaped cross section as shown in FIG. 6. Such recesses may be provided for each acurate segment although lack of a good grip is most significant in removing the first of the segments. Hence the provision of two diametrically opposed recess 91 should be sufficient.

Portability of the central hub 21 may be enhanced by providing the lower lip 26 of the outer annular portion 25 with hand-holds 101 in FIGS. 2 and 5. The upper surface of the hand-holds 101 comprises a convex semi-cylindrical outer section 103 and a concave semi-cylindrical inner section 105 which are joined along one edge to give a generally S-shaped cross section. The edge of the outer section 103 remote from where the sections 103 and 105 join extends upward to meet with the front face 30 of the lower lip 26. The edge of the inner section 105 remote from the joinder with the outer section 103 extends downward to meet with the bottom layer of the central hub. The curvature of the outer cylindrical section 103 provides a more comfortable support than that provided by what would otherwise be a rather sharp edge.

The bottom of the semi-cylindrical outer section 103 is higher than the bottom of the central hub 21 by an amount which allows fingers to be slid under the outer section 103 while the hub 21 rests on a planar surface.

The strength of the handhold 101 can be increased by extending the semi-cylindrical inner section to meet with the joint between the top surface 28 of the lower lip 26 and the outer edge 40 of the annular portion. Joining the inner section 105 to the joint between the top surface 28 of the lip 26 and the outer edge of the annular portion still further strengthens the hand-hold 101. Such joining can be achieved for example by glueing or fusion.

Whilst the slots 63 shown in FIGS. 1 and 4 are of a rounded T-shape, it will be appreciated that any shape can be used which enables the central hub 21 to be separated from the arcuate segments 41 in a vertical or axial direction but prevents separation radially.

Top and bottom surfaces of the central hub 21 and the arcuate segments 41 can be coated with an elastomeric material shown as 75 in FIGS. 2 and 3, to provide good traction for the pitcher's feet, reduce movement of the pitcher's mound when it is placed on a smooth hard surface such as a gymnasium floor, and to absorb some of the energy when the pitcher's mound is struck by a ball so as to simulate a conventional clay mound. This should reduce the likelihood of injury to the pitcher if the ball deflects toward the pitcher and more closely simulate the deflection of a clay or earth mound than would be possible with a hard-surfaced pitcher's mound. The gradual curvature of the pitcher's mound from the outer edge 45 which is at ground level to the top of the inner portion 23 of the central hub also prevents deflections of the ball by the pitcher's mound which would be uncharacteristic of a traditional clay or earth pitcher's mound. An example of a resilient coating which may be used is a self-skinning integral foam padding. Alternatively, the top surfaces of the hub 21 and the arcuate segments 41 can be of a textured finish which will provide the desired impact absorbing and traction properties. This is preferred for simplicity of construction and economy.

The appropriate surfaces of the mound 11 can be provided with small recesses 76 or the like to assist in keying the elastomeric material 75 to the mound 11. Also, as shown in FIGS. 2 and 3 and in the underneath view of FIG. 5, around the edge of the mound 11, the material 75 can form an outer lip 81 provided with regularly spaced rectangular recesses 83 in the bottom thereof.

Further, on the underside as shown, the coating of material 75 can be omitted from the inner annular ring 24. In this case the bottom of the inner annular ring, as moulded as part of the bottom layer 39, can be lower than the bottom of the outer annular ring 24 by an amount equal to the thickness.

The hub 21 and segments 41 should preferably be so shaped as to permit ready moulding of them. For this purpose various surfaces may need to be given a slight taper, and terms such as "vertical" should be construed accordingly.

It is to be understood that what has been described are preferred embodiments of the invention and it is possible to make variations to these embodiments while staying within the scope of the invention. Thus, for example, each segment could be adapted to engage adjacent segments. Thus each segment could include a T-shaped slot on one side and a corresponding T-shaped groove on the other side. These should extend the full thickness of the segments, to permit any one segment to be freely disengaged.

Also, whilst the mound 11 is shown with a full complement of arcuate segments 41, this need not always be the case. A full set of segments 41 enables the mound 11 to be used for all training purposes, for example in picking runners off at the bases etc. However, in many cases, an institution either will not have the funds for a full mound 11, or will not have storage space for it. In such a case, a few segments 41 will suffice for pitching practice; the rear and side segments are not needed. The mound 11 could be configured so that just one segment 41 is sufficient. This provides a cheaper assembly, which is sufficient for pitching practice. Further arcuate segments 41 can be added later if desired.

I claim:

1. A portable pitcher's mount used to slightly elevate a selected portion of a common horizontal support plane from whereupon a pitcher pitches a ball, said pitcher's mound inserted; comprising a central hub and a plurality of individual components surrounding the central hub, which can be disassembled and separated, and connecting means for releasably connecting the individual components and the central hub together to form said pitcher's mound, wherein each of the components has a top layer and a bottom layer, whereby when assembled, the top layers of the components form a top surface of the pitcher's mound, and at least part of the bottom layer of each component lies in said common horizontal support plane.

2. A pitcher's mound as claimed in claim 1, wherein the individual components comprise a plurality of arcuate segments, and wherein the connecting means releasably connects the arcuate segments to the central hub.

3. A pitcher's mound as claimed in claim 2, wherein the connecting means comprises slots and projections which alternate around the periphery of the central hub, and projections and slots on the arcuate segments corresponding to the slots and projections of the central hub, the slots and projections enabling the arcuate segments to be secured against horizontal movement relative to the central hub, whilst permitting vertical displacement and disengagement between the central hub and the arcuate segments.

4. A pitcher's mound as claimed in claim 3, wherein each of the slots and projections of the central hub is generally T-shaped, and the projections and slots of the arcuate segments corresponding.

5. A pitcher's mound as claimed in claim 4, wherein each arcuate segment includes a curved inner face, a T-shaped slot opening onto the curved inner face and a pair of projections on either side of the T-shaped slot, with each slot of the central hub receiving two adjacent projections from two adjacent arcuate segments.

6. A pitcher's mound as claimed in claim 4 or 5, wherein the central hub and the arcuate segments, when assembled, form a domed structure, the height of which decreases radially outwards, with the arcuate portions being relatively flush to a planar underlying surface.

7. A pitcher's mound as claimed in claim 4 or 5, wherein the central hub comprises inner and outer annular portions, with the inner annular portion being provided above the outer annular portion to form an annular step therebetween, and wherein the outer annular portion has a lower lip projecting radially outward therefrom, and wherein the slots and projections of the central hub are provided in the outer annular portion and each arcuate segment includes a radially ascending inner lip extending over the step to the inner annular portion and a radially descending lower recess extending over the lower lip projecting from the outer annular portion.

8. A pitcher's mound as claimed in claim 1, wherein each component is hollow and includes top and bottom layers joined at the periphery of that component.

9. A pitcher's mound as claimed in claim 8, wherein the bottom layer of each component includes portions that extend upwardly to close to the top layer, with portions of the bottom layer being joined to the top layer to reinforce the component.

10. A pitcher's mound as claimed in claim 3, wherein the central hub and each arcuate segment is hollow and formed from the top and bottom layers joined together at the periphery thereof.

11. A pitcher's mound as claimed in claim 10, wherein the bottom layer of the central hub includes annular rings having a generally "U"-shaped cross-section, with portions of the bottom layer apart from the annular rings being adjacent to the top layer.

12. A pitcher's mound as claimed in claim 11, wherein the bottom layer of each arcuate segment includes radially extending ribs having generally "U"-shaped cross-sections, with portions of the bottom layer between the ribs being adjacent the top layer thereof.

13. A pitcher's mound as claimed in claim 12, wherein the part of the bottom layer of the central hub between the annular rings includes portions extending upwardly and joined to the top layer of the central hub, to provide reinforcement, and wherein the parts of the bottom layer of each arcuate segment between the ribs thereof include portions extending upwardly and joined to the top layer thereof, to provide reinforcement.

14. A pitcher's mound as claimed in claim 13, wherein each of the slots and projections of the central hub is generally T-shaped with the slots and projections of the arcuate segments corresponding.

15. A pitcher's mound as claimed in claim 14 wherein the central hub comprises an outer annular portion and an inner annular portion above the outer annular portion, with a step therebetween, and wherein the outer annular portion has a lower lip projecting radially outward therefrom, and wherein each of the slots and projections of the central hub is provided in the outer annular portion and is generally T-shaped, and each arcuate segment includes one slot having a T-shaped cross-section corresponding to a projection of the central hub with two projections on either side of that slot, and an upper lip extending radially inwards above the step and a radially descending lower recess extending over the lower lip which projects from the outer annular portion, each slot of the outer annular portion being engaged by two adjacent projections of two adjacent arcuate segments.

16. A pitcher's mound as claimed in claim 3, 12, or 15, wherein the central hub includes a divot and a pitcher's rubber integral with a top surface thereof.

17. A pitcher's mound as claimed in claim 3, 12 or 15 wherein the central hub includes a divot and a pitcher's rubber integral with a top surface thereof, and wherein top surfaces at least of the central hub and each arcuate segment are coated with a resilient material.

18. A pitcher's mound as claimed in claim 3, 12 or 15, wherein the central hub includes a divot and a pitcher's rubber intergral with a top surface therof, wherein top surfaces of at least of the central hub and each arcuate segment are coated with a resilient material and are textured.

19. A pitcher's mound as claimed in claim 3, wherein the central hub includes at least one handhold, and at least one recess providing access to the inner edge of an arcuate segment 20. A pitcher's mound as claimed in claim 3, 12 or 15, wherein the central hub includes a plurality of handholds in an underside of the central hub and opening on the sides therof, and a plurality of recesses in a top surface thereof, which provide access to an inner edge of each arcuate segment.

21. A pitcher's mound as claimed in claim 20, wherein the central hub includes a divot and a pitcher's rubber.

22. A pitcher's mound as claimed in claim 1, 2, 3 or 12, which comprises a central hub and only sufficient individual components to form a front face of the mound, the front face being formed by the top layers of the individual components.

23. A pitcher's mound to slightly elevate a selected portion of a common horizontal support plane from whereupon a pitcher pitches a ball, said pitcher's mound comprising a plurality of arcuate segments, which can be disassembled and separated, and connecting means for releasably connecting the individual arcuate segments together to form said pitcher's mound, wherein each of the arcuate segments has a top layer and a bottom layer, whereby when assembled, the top layers of the arcuate segments form a top surface of the pitcher's mound, and at least part of the bottom layer of each arcuate segment lies in said common horizontal support plane.

24. A pitcher's mound as claimed in claim 23, wherein the arcuate segments include complementary slots and projections which engage with one another to secure the arcuate segments together, and which can be disengaged in a vertical direction.

25. A pitcher's mound as claimed in claim 24 wherein the arcuate segments include a divot and a pitcher's rubber integral with a top surface thereof and the arcuate segments are textured and include recesses and handholds to facilitate disassembly.

* * * * *